US006038769A

United States Patent [19]

Bonny et al.

[11] Patent Number: 6,038,769

[45] Date of Patent: Mar. 21, 2000

[54] METHOD FOR MANUFACTURING AN AIR-GAP-INSULATED EXHAUST MANIFOLD

[75] Inventors: Pierre Bonny; Norbert Kreutzig, both of Hamburg; Thorsten Sternal, Moisburg, all of Germany

[73] Assignee: DaimlerChrysler AG, Stuttgart, Germany

[21] Appl. No.: 09/025,857

[22] Filed: Feb. 19, 1998

[30] Foreign Application Priority Data

Feb. 19, 1997 [DE] Germany ..... 197 06 386

[51] Int. Cl.[7] ..... B23P 15/00

[52] U.S. Cl. ..... 29/890.08; 29/890.054

[58] Field of Search ..... 29/890.08, 428, 29/890.054

[56] References Cited

U.S. PATENT DOCUMENTS

| | | | |
|---|---|---|---|
| 4,590,652 | 5/1986 | Harwood | 29/890.08 |
| 4,656,713 | 4/1987 | Rosa et al. | 29/416 |
| 5,170,557 | 12/1992 | Rigsby | 29/890.08 |
| 5,491,883 | 2/1996 | Marlinga | 29/890.08 |
| 5,799,395 | 9/1998 | Nording et al. | 29/890.08 |

FOREIGN PATENT DOCUMENTS 44 37 380 7/1995 Germany .

195 11 514 8/1996 Germany .

*Primary Examiner*—I. Cuda

*Attorney, Agent, or Firm*—Evenson, McKeown, Edwards & Lenahan, P.L.L.C.

[57] ABSTRACT

A method for manufacturing an air-gap-insulated exhaust manifold, including exhaust-conducting inner tube sections and an outer shell divided into an upper shell and a lower shell, with the inner tube sections, of which at least one is designed as a curved tube, being plugged into one another. The inner tube sections plugged into one another are inserted as an assembled component into the lower shell, centered relative to the outer shell that is formed later, with the upper shell then being placed on the lower shell and pressed against the latter. Then the upper and lower shells and the inner tube sections are welded to the outer shell at those points at which they pass through the outer shell. In order in simple fashion always to ensure a sliding fit on the inner tube sections as well as the formation of a uniform air gap insulation of the inner tube sections following completion of the manufacture of the exhaust manifold, it is proposed to connect the inner tube sections with each other forcewise before they are inserted into the lower shell by means of a connecting element in each case made of a heat-volatile material, with the connecting elements being dissolved under the influence of heat following the welding of the upper and lower shells with the inner tube sections.

13 Claims, 2 Drawing Sheets

METHOD FOR MANUFACTURING AN AIR-GAP-INSULATED EXHAUST MANIFOLD

This application claims the priority of German application no. 197 06 386.1, filed in Germany on Feb. 19, 1997, the disclosure of which is expressly incorporated by reference herein.

BACKGROUND AND SUMMARY OF THE INVENTION

The invention relates to a method for manufacturing an air-gap-insulated exhaust manifold.

A method for manufacturing an air-gap-insulated exhaust manifold is known from German Patent Document DE 195 11 514 C1. The exhaust manifold in that document is composed of three inner tube sections as well as an upper shell and a lower shell that form the outer shell. The inner tube sections, consisting of a 90° curved tube, a tee, and an intake tube section, are inserted into one another in the above sequence on the assembly line with a sliding fit, with the tee in each case having one end of its cross beam connected with the other two tube sections. The ends of the tube sections that are not connected with one another lie parallel to one another in a plane and each have flanges for bolting to a cylinder head of an internal combustion engine. The intake tube section, made approximately in the shape of a Y, has also a second free end that is not aligned parallel to the other ends of the remaining inner tube sections, but extends in a direction opposite to them. An outlet flange is mounted at the second free end of the intake tube section, to which an exhaust line, possibly with a catalytic converter, can be connected. For preliminary centering of the inner tube sections during assembly inside the later outer shell, forming the desired uniform air gap, before the parts are inserted into one another, spacing rings are pushed onto the individual sections. These rings are made of a material that dissolves during later operation of the exhaust system as a result of the heat of the exhaust, so that the inner tube sections can expand freely radially under the alternating thermal stresses produced by operation. The inner tube sections are placed in the lower shell in the inserted position, and then the upper shell is placed on the lower shell and pressed against it by a mechanically controlled press. Then the inner tube sections are welded to the mouth openings at the outer shell, with centering being retained. Then the upper shell is welded to the lower shell at the edges.

The overlapping areas of the inner tube sections are generally short in terms of their lengthwise extent because of the dimensions of the section ends, so that the sections are relatively movable in the outer shell and the curved tube in particular can be loosened from the shell without difficulty. Because of the loose connection of the inner tube sections to one another by the desired sliding fit in the plug connection, with the degree of looseness depending to a large degree on the manufacturing tolerances of the inner tube sections in the radial direction, it can happen that as a result of vibration of the parts during assembly, for example during manual mounting of the upper shell on the lower shell and during subsequent mechanical pressure, as well as by the centrifugal forces that occur during the pivoting movement of the turntable during the transfer of the assembled part from the assembly station to the welding station, the inner tube sections shift, causing the plug connections to come loose. This occurs in particular with the curved tube section that can almost twist free of the connection.

As a result of the loosening of the plug connection, the continuous flow of gas is disrupted, which later results in considerable problems of the exhaust flow during driving and as a result of the sharp increase in flow resistance that takes place, leads to high engine power losses. Similarly, the air gap insulation is eliminated since the hot exhaust can flow unimpeded through the outer shell. Moreover, the loose ends of the inner tube sections can cause irritating rattling sounds during driving, whenever sections strike the outer shell.

Furthermore, welding the curved tubes to the inside of the outer shell is highly problematic, since the curved tube is positioned at an angle as a result of its rotation out of the plug connection at the mounting end, so that the welding robot which cannot detect such deviations in the relative positions of the two welding connection partners from the programmed required range, does not act at the correct position, so that the welded connection, if it is indeed produced in some way, cannot withstand any mechanical stresses. Moreover, the curved tube can be loosened from the plug connection to an extent such that it covers the correspondingly designed outlet of the outer shell with its end, so that a hollow welded seam is no longer possible so that the curved tube cannot be attached to the outer shell. Of course it is possible for the fitter to compensate for the manufacturing tolerances of the inner tube sections as far as the loosening of the plug connection is concerned by carefully varying the depth of penetration, so that the manufacturing process described above takes place completely and with perfect qualitatively. Usually however a there is not sufficient time for the necessary care because of shorter processing cycle times. In addition, human error can always be expected, which means that the inner tube sections are inserted for much too short a distance into one another.

A goal of the invention is to improve on a method of the above-discussed type such that, in a simple fashion, a sliding fit of the inserted inner tube sections, as well as the formation of a uniform air gap insulation of the inner tube sections following completion of the manufacture of the exhaust manifold is always guaranteed.

This goal is achieved according to the invention by providing a method for manufacturing an air-gap-insulated exhaust manifold, said manifold being formed of an exhaust-conducting inner tube assembled from individual sections and an outer shell divided into a upper shell and a lower shell, designed to match the shape of the inner tube, with the inner tube sections, of which at least one is designed as a curved tube, being inserted into one another and in which the inside diameter of the respective receptacle of one tube section is larger than the outside diameter of the tube section end of the other tube section to be inserted into this receptacle, being inserted centered as a assembled part into the lower shell of the outer shell, with the upper shell then resting on the lower shell and being pressed against the latter, and with welding of the upper and lower shells and the inner tube sections with the outer shell then being performed in the vicinity of their outlet openings, characterized in that inner tube sections before the insertion of inner tube into lower shell are connected forcewise with one another by means of a connecting means made of heat-volatile material, with the connecting means, following welding of the upper and lower shells with the inner tube sections, being dissolved under the influence of heat.

By virtue of the invention, following the assembly process, a plug connection is made possible that is initially rigid and is later movable during driving within the scope of the play and thermal expansion and/or contraction of the inner tube section. The background of an initially rigid plug connection lies in the exact location and alignment of the inner tube sections with respect to one another as well as of the inner tube sections with respect to the outer shell. The former is necessary because otherwise, during the operation of the exhaust system, the inserted ends of the inner tube sections in their active receptacles become tilted, so that the desired sliding fit of the plug connections is suppressed. However, this is unavoidable for compensation of the relative movement of the plug partners which takes place as a result of changing thermal loads. The latter is necessary for the uniformity of the insulating air gap between the outer shell and inner tube.

In addition, manual assembly errors and shifting of the plug partners with respect to one another, which arise from mechanical pivoting movements and vibrations during mounting and installation of the upper shell, with the respective insertion depth becoming unacceptably short, is avoided by forcewise connection. The limited insertion depth leads to tilting of the plug partners as a result of the inserted plug partner sliding out. In addition, the slip-free connection achieved by the invention permits exact positioning of the end of the curved tube end of the inner tube at the outer shell, so that optimum welding can be performed between the outer shell and the inner tube in this area. When this welding is performed, the inner tube remains centered immovably in the outer shell and remains aligned optimally between the inner tube sections with respect to a perfectly functioning sliding fit. In order to produce a sliding fit, the rigid plug connection must be released after welding. This is accomplished simply and advantageously by the action of heat, causing the connecting means which previously provided the rigid connection to melt. Thus, the invention firstly guarantees a functioning sliding fit once manufacture of the exhaust manifold is complete and secondly guarantees uniform air gap insulation. In addition, the inner tube, assembled separately, can be delivered as a preassembled component to the assembly line, saving production time. The preassembled structural unit need then only be inserted into and welded to the outer shell.

Other objects, advantages and novel features of the present invention will become apparent from the following detailed description of the invention when considered in conjunction with the accompanying drawings.

DETAILED DESCRIPTION OF THE DRAWINGS

Figure 1:
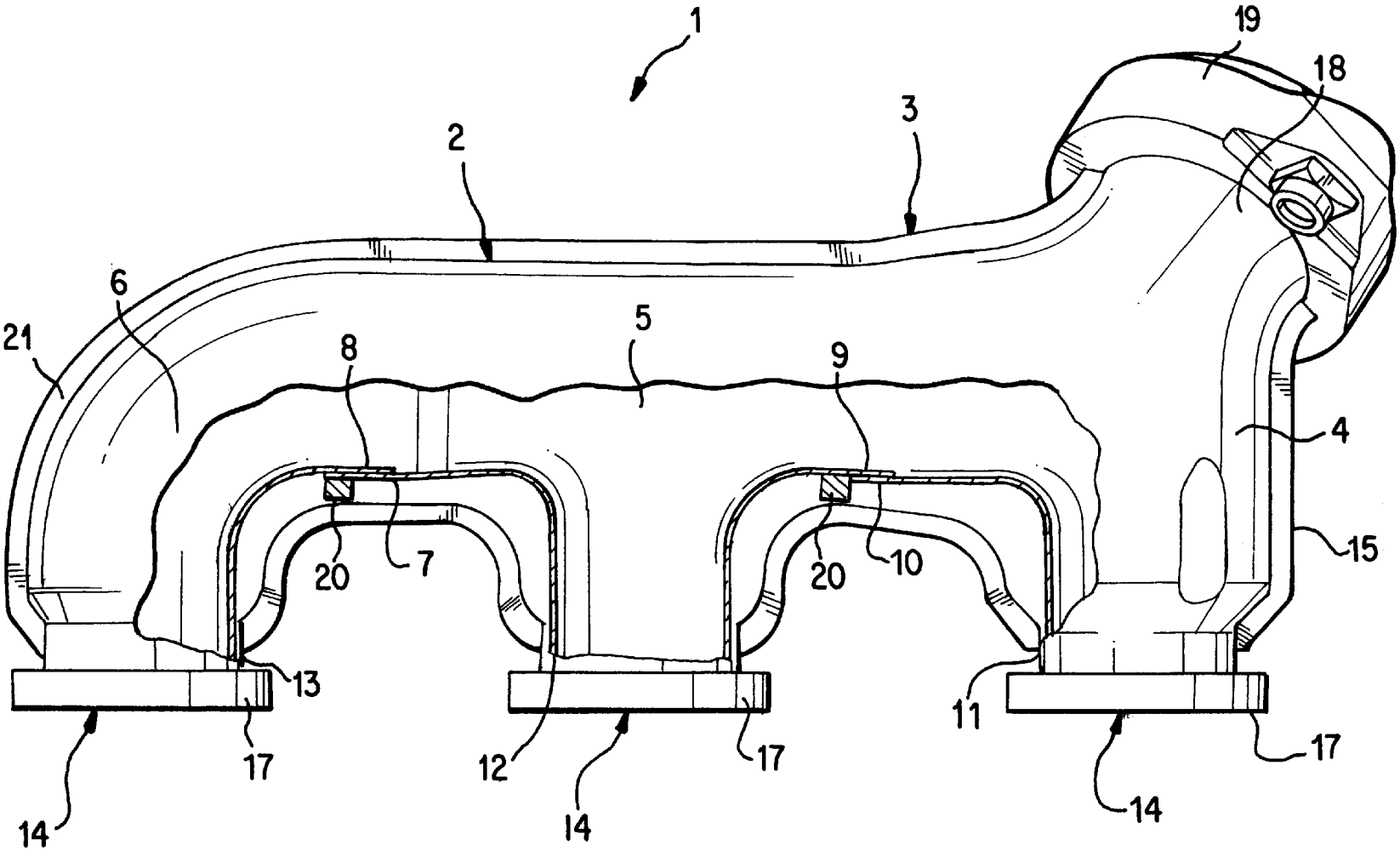
FIG. 1 is a lateral longitudinal sectional view of an exhaust manifold according to the invention, shown without connecting means on the inner tube sections.

FIG. 1 shows an air-gap-insulated exhaust manifold 1, said manifold consisting of an inner tube 2 that conducts exhaust and an outer shell 3 adapted to the shape of inner tube 2. Inner tube 2 in turn consists of three sections, a Y-shaped intake tube section 4, a tee 5, and a 90° curved tube 6. The cross beam of tee 5, on the curved tube side, forms with its end which faces it and is inserted into it. On the other side, end 9 of the cross beam is inserted into the sliding fit receptacle 10 of intake tube section 4, with the latter being formed by one end of the fork of the Y-shape of tube section 4. The other end 11 of the fork, the free end 12 of tee 5, and free end 13 of curved tube 6 lie parallel to one another in a plane.

At their mouth openings 14, ends 11, 12, and 13 are welded with outer shell 3 composed of a lower shell 15 and an upper shell, with only lower shell 15 shown here in FIG. 1 for the sake of illustration, forming a hollow weld. Mouth openings 14 for this purpose are set back relative to the adjacent outlet openings 16 of outer shell 3. Inlet flanges 17 are welded in turn to these openings, by which the exhaust manifold 1 is bolted to a cylinder head of an internal combustion engine. At foot end 18 of intake tube section 4, the latter is likewise welded to outer shell 3 in the vicinity of the mouth opening, with outer shell 3 supporting an outlet flange 19 to which an exhaust line of an exhaust system can be fastened in a gas-tight manner.

A slotted spacing ring 20 is slid onto end 8 of curved tube 6 and end 9 of tee 5 in the vicinity of the sliding seat, by means of which ring the assembled inner tube 2 is centered in outer shell 3, with a nearly uniformly expanded heat insulating gap 21 being formed between inner tube 2 and outer shell 3. Spacing rings 20 do align inner tube sections 4, 5, 6 with respect to one another, to prevent tilting from occurring during later driving, but the manufacture of such spacing rings 20 is also subject to tolerances, so that the probability of an optimum alignment is low. In addition, a certain amount of play must be provided in order to insert inner tube sections 4, 5, 6 into one another and to ensure the formation of a sliding fit.

Spacing rings 20 consist of a material that is volatile when heated, preferably polyethylene, where spacing rings 20 decompose and/or burn up after inner tube 2 is exposed to hot exhaust. The undesired heat transfer that exists between inner tube 2 and outer shell 3 because of the application of the respective spacing rings 20 on both sides is suppressed, and ends 8, 9 are exposed, so that curved tube 6 and tee 5 can expand freely there in response to the heat stress.

In order to ensure the optimum alignment, a connecting means is used for the plug connection (not shown in this embodiment), said means taking on a rigid shape by producing a forcewise connection between two plug partners, with a precisely defined arrangement of the two plug partners with respect to one another being made possible. The connecting means can be an adhesive strip applied all the way around in the respective receptacles 7, 10 of inner tube sections 4, 5, and consisting of a material with the same properties regarding the action of heat as spacing rings 20. The forcewise connection is then produced when inner tube sections 4, 5, 6 are inserted into one another.

It is also contemplated according to certain embodiments of the invention for the forcewise connection to be produced following the insertion of inner tube sections 5, 6 by wrapping of the plug connection by means of a strip with an adhesive action that forms the connecting means.

It is also contemplated according to certain embodiments of the invention for the connecting means to be formed by an elastic sleeve that is pushed onto the receiving end 7, 10 of one inner tube section 4, 5. The end 8, 9 of the other inner tube section 5, 6 to be inserted is pushed through the sleeve, with both the pushing of the sleeve onto an inner tube section 4, 5 and the sliding of the inserted end 8, 9 of the other inner tube section 5, 6 through the sleeve being performed frictionwise. This can also consist of a rubber-like bending-resistant and heat-volatile material and fits closely against the respective plug partner. Axial movements of the plug partners are compensated elastically, so that the partners are always returned to their original plug positions. Spacing rings 20 are then effective as far as centering is concerned, only to support the respective connecting means.

Figure 2:
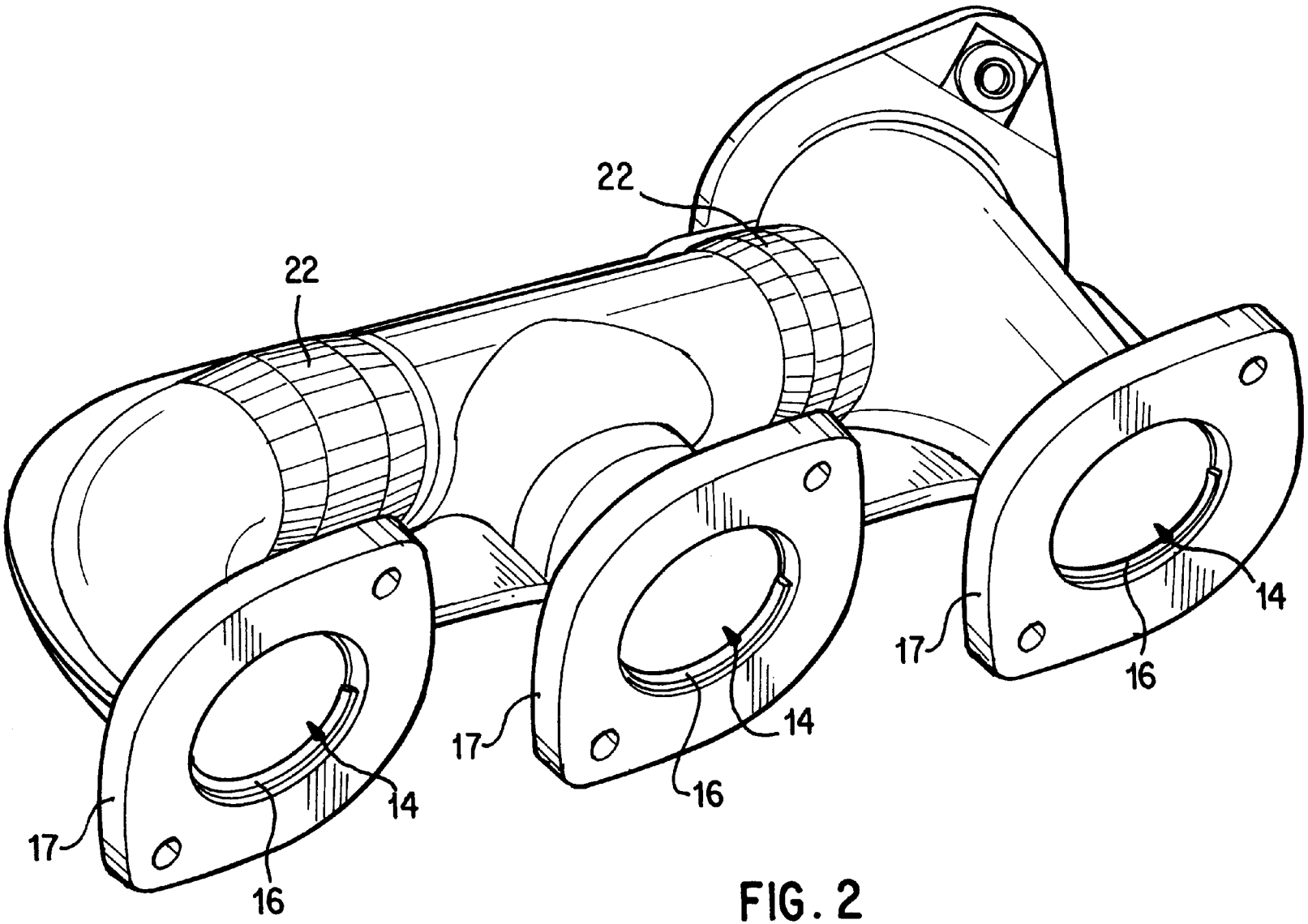
FIG. 2 is a perspective view of an exhaust manifold according to the invention with connecting means on the inner tube sections and with the upper shell removed.

As an alternative to the embodiment in FIG. 1, in FIG. 2 the ends 7, 8 and end 9 and sliding seat receptacle 10 are rigidly connected together by a sleeve 22 slid onto them, said sleeve consisting of a heat-volatile material and, after an initially loose fit, being shrunk under the influence of heat onto the ends 7, 8 and end 9 and sliding seat receptacle 10. Because the thickness of sleeve 22 is uniform all the way around, inner tube 2 is centered automatically in outer shell 3 when inserted into the latter, with insulating gap 21 being simultaneously set. In sleeve 22, which essentially provides a rigid connection between inner tube sections 4, 5, 6, the gap-forming function of spacing rings 20 is integrated to a certain degree, so that the rings can be eliminated. To support the centering action, spacing rings 20 however can be located in other areas of inner tube 2, advantageously in the vicinity of the knee of curved tube 6. Sleeve 22 can also be a piece of hose.

Optimum centering of inner tube 2 can take place automatically upon insertion into lower shell 15 by spacing beads of sleeve 22 that are located suitably on the circumference and project radially, with the contact between sleeve 22 and lower shell 15 being minimized, so that surface irregularities of sleeve 22, that is shrunk, and is in contact over a large area, and manufacturing tolerances of lower shell 15 no longer need be considered for centering of the inner tube 2.

For example, in the following, the manufacturing method for the exhaust manifold with sleeve 22 as the connecting means will be shown. First a sleeve 22 is pushed onto end 7 of tee 5 and onto end 10 of intake tube section 4. Then inner tube sections 4, 5, 6 are inserted into one another, with end 8 of curved tube 6 being received in end 7 of tee 5 and end 9 of tee 5 being received in end 10 of intake tube section 4 with respective formation of a sliding fit. End 8 of curved tube 6 and end 9 of tee 5 are pushed through sleeve 22. In this inserted position, sleeve 22 is shrunk under the influence of heat, for example by means of a hair dryer, onto ends 7, 8 and 9, 10. As a result, the plug connection of the inner tube sections 4, 5, 6, aligned with one another is rigidly established and the sliding fit initially loses its effect.

Then inner tube 2 is inserted into lower shell 15 and positioned, and the upper shell is laid on lower shell 15. A press then presses on the upper shell, causing it to fit exactly on lower shell 15. An assembly formed on the turntable of a welding station (welding robot) is transferred by pivoting the turntable. At the station, at mouth openings 14 on inner tube 2, the tool is laser-welded all the way around forming a hollow weld on outer shell 3 internally. Then inlet flanges 17 are pushed onto ends 11, 12, 13 of inner tube sections 4, 5, 6 and outlet flange 19 is pushed onto end 18 of intake tube section 4 and likewise laser-welded.

This is followed by local heat treatment at the points of shrunk sleeves 22, whereupon the sleeves are dissolved without any residue in the plug connection and thus permit the sliding fit once more. Then the manufacture of exhaust manifold 1 is complete. Heat treatment can also be performed subsequently in simple fashion by exposure to the heat of the exhaust with the engine running.

It is also possible, instead of a friction fit connection, to use a latching connection in which the latching elements likewise consist of a heat-volatile material. Moreover, the plug connection can also be secured by exposure to the brief action of cold at the location of the plug connection so that as a result of contraction of the respective receptacle, the corresponding plugged end is secured by clamping action.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. In a method for manufacturing an air-gap-insulated exhaust manifold formed of an exhaust-conducting inner tube, assembled from individual sections, and an outer shell, divided into an upper shell and a lower shell and designed to match the shape of the inner tube, comprising the steps of inserting inner tube sections, of which at least one is designed as a curved tube, into one another to form the inner tube, the inside diameter of the respective receptacle of one tube section being larger than the outside diameter of the tube section end of the other tube section to be inserted into this receptacle, inserting the inner tube centered as an assembled part into the lower shell of the outer shell, resting the upper shell on the lower shell and pressing it against the latter, and welding the upper and lower shells with the inner tube sections in the vicinity of their outlet openings, the improvement comprising the steps of:

connecting the inner tube sections forcewise with one another before inserting the inner tube into the lower shell by a connector made of heat-volatile material, and dissolving the connector under the influence of heat after welding the upper and lower shells with the inner tube sections.

2. Method according to claim 1, wherein the step of dissolving the connector is performed under the influence of exhaust heat.

3. Method according to claim 1, wherein the step of connecting the inner tube sections forcewise takes place as a result of inserting the inner tube sections.

4. Method according to claim 1, wherein the step of connecting the inner tube sections forcewise is performed by wrapping the plug connection with a strip that forms the connector by gluing after inserting the inner tube sections into one another.

5. Method according to claim 1, and further comprising the steps of pushing an elastic sleeve forming the connector on to the receiving end of one inner tube section, and pushing the end of the other inner tube section through the elastic sleeve.

6. Method according to claim 5, wherein the steps of pushing the elastic sleeve and pushing the end of the other inner tube section both take place frictionwise through the sleeve.

7. Method according to claim 5, and further comprising the step of shrinking the sleeve onto the inner tube sections after they are plugged into one another by the action of heat.

8. Method according to claim 1, and further comprising the step of pushing slotted spacing rings made of a material that dissolves under the influence of heat individually onto the inner tube sections so that centering of the individual inner tube sections takes place.

9. Method according to claim 5, and further comprising the step of automatically centering the inner tube sections by radially projecting spacing beads of the sleeve when inserted into the lower shell.

10. Method of making an air-gap-insulated exhaust manifold, comprising:

providing a plurality of inner tube sections of which at least one is a curved tube;

inserting respective small diameter ends of respective inner tube sections into respective larger diameter ends of respective other inner tube sections to form an inner tube manifold assembly;

connecting each respective pair of said small and larder diameter ends of the inner tube sections by at least one heat volatile material connector;

providing a lower shell conforming in shape to the inner tube manifold assembly;

placing the inner tube manifold assembly in the lower shell;

placing an upper shell on the lower shell and connecting the shells together with said inner tube manifold assembly disposed therebetween and spaced therefrom by at least one other heat volatile material connector; and applying heat to dissolve each heat volatile material connector.

11. Method according to claim 10, wherein applying heat is done under the influence of exhaust gas heat from exhaust gas passing through the inner tube manifold assembly.

12. Method according to claim 10, wherein connecting each respective pair of ends is performed following insertion of the inner tube sections by wrapping each plug connection with a strip that forms the connector by gluing.

13. Method according to claim 10, wherein connecting each respective pair of ends includes pushing the connector on to the receiving end of one inner tube section, through which sleeve the end of the other inner tube section to be inserted is pushed.

* * * * *